United States Patent [19]

Wartian

[11] Patent Number: 4,864,835

[45] Date of Patent: Sep. 12, 1989

[54] DOOR LATCH MECHANISM

[76] Inventor: George Wartian, 20525 Nine Mile Rd., St. Clair Shores, Mich. 48080

[21] Appl. No.: 185,433

[22] Filed: Apr. 25, 1988

[51] Int. Cl.[4] ..... E05B 59/00

[52] U.S. Cl. ..... 70/107; 70/110; 292/221; 292/226; 292/DIG. 37

[58] Field of Search ..... 70/91, 101, 107, 110, 70/111, 134, 467, 468, 473, 474, 477, 478, 484, 488, 116, 451; 292/200, 226, 336.5, DIG. 37, DIG. 62, 221

[56] References Cited

U.S. PATENT DOCUMENTS

| | | | |
|---|---|---|---|
| 1,383,088 | 6/1921 | Earle | 292/DIG. 37 X |
| 2,759,351 | 8/1956 | Allen | 292/DIG. 37 X |
| 2,773,376 | 12/1956 | Wartian | 292/226 X |
| 2,818,722 | 1/1958 | Shaw et al. | 70/488 |
| 2,824,441 | 2/1958 | Wartian | 292/226 X |
| 3,044,816 | 7/1962 | Nazurian | 292/226 X |
| 3,100,388 | 8/1963 | Wartian | 292/226 X |
| 3,174,608 | 9/1964 | Turner et al. | 70/468 |
| 3,188,840 | 6/1965 | Wartian | 292/DIG. 37 X |
| 3,677,591 | 7/1972 | Waldo | 292/226 X |
| 3,991,595 | 11/1976 | Bahry et al. | 70/116 X |
| 4,520,639 | 6/1985 | Wartian | 70/110 |
| 4,696,174 | 9/1987 | Marks | 70/451 |

*Primary Examiner*—Gary L. Smith
*Assistant Examiner*—Douglas E. Ringel
*Attorney, Agent, or Firm*—Barnes, Kisselle, Raisch, Choate, Whittemore & Hulbert

[57] ABSTRACT

A door latch and lock mechanism especially for storm doors and screen doors, having a latch and a lock bolt. The latch can be retracted from the outside by a button which pushes a plunger in a lengthwise direction. When the plunger is rotated in one direction it will lock the latch in the latched position and also extend the locking bolt to its locked position. When the plunger is rotated in the opposite direction, the latch is released and the bolt is retracted. The plunger is rotated in one direction or the other from the outside of the door by a key operated mechanism spaced from the push button and operatively connected to the plunger by connecting links.

5 Claims, 2 Drawing Sheets

FIG. 1
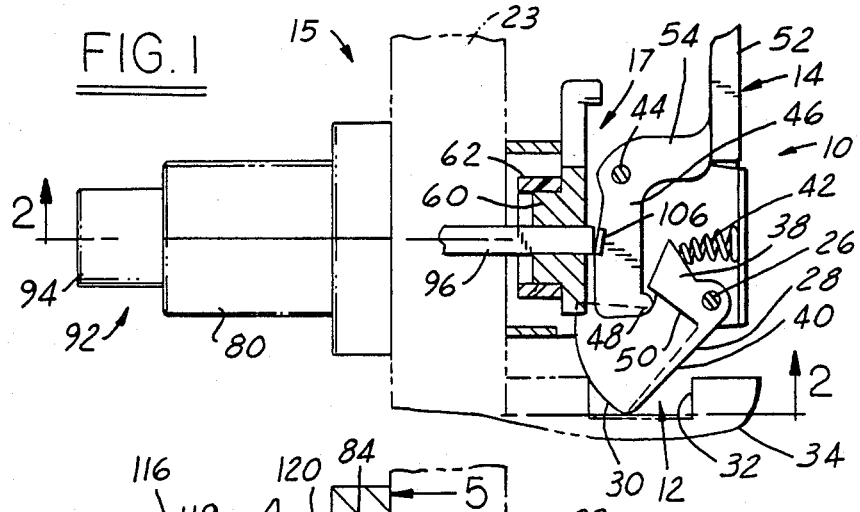
FIG. 2
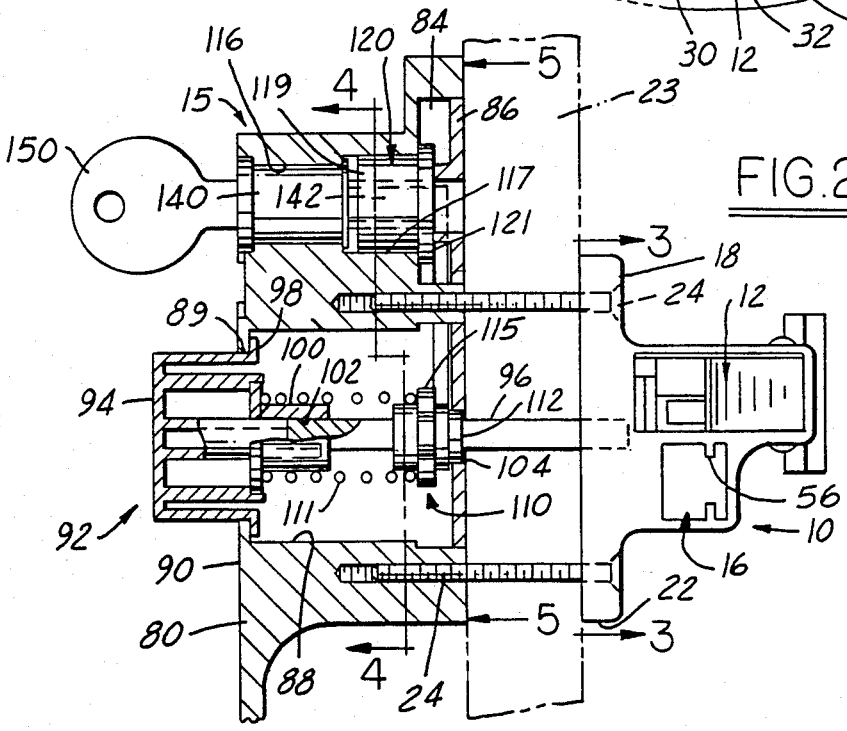
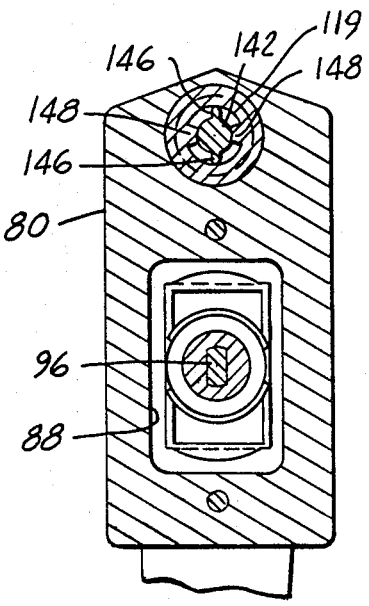
FIG. 4
FIG. 3
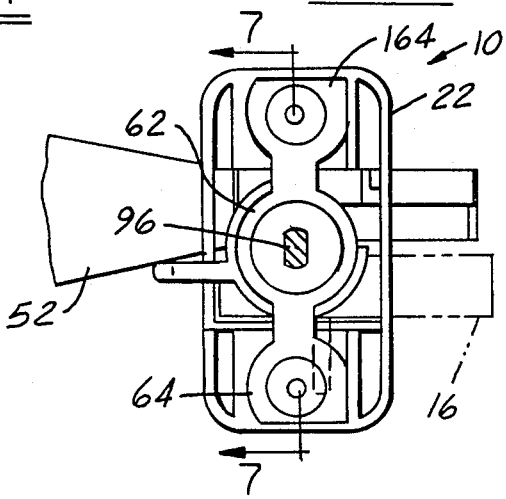

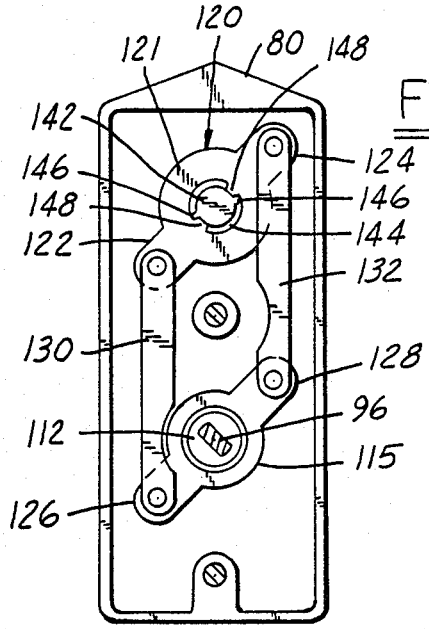
FIG.5
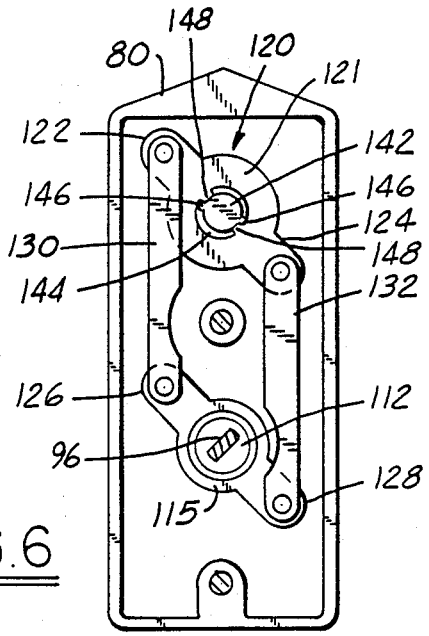
FIG.6
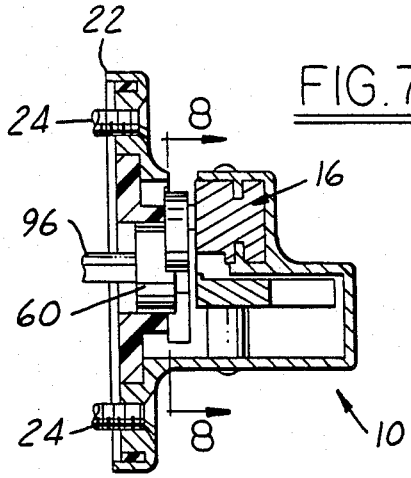
FIG.7
FIG.8
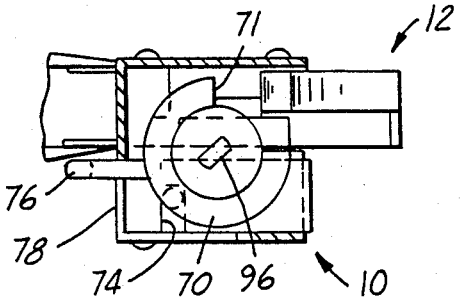
FIG.9
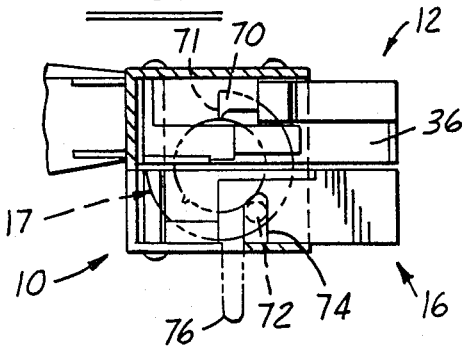

DOOR LATCH MECHANISM

This invention relates generally to latch mechanisms and refers more particularly to a door latch mechanism for storm doors and screen doors and the like.

BACKGROUND AND SUMMARY OF THE INVENTION

Storm doors and screen doors in present use are locked and unlocked from the outside by means associated with and incorporated in the latch operating handle. This positioning of the means for locking and unlocking immediately marks the door as a storm or a screen door, rather than the primary door of the dwelling. Primary doors usually place the outside lock operating mechanism above the latch operating mechanism.

One of the objects of this invention is to provide a construction in which the lock operating mechanism on the outside of the storm or screen door is displaced from the latch operating mechanism, so that the storm or screen door has the appearance of a primary door.

These and other objects of the invention will become more apparent as the following description proceeds, especially when considered with the accompanying drawings.

BRIEF DESCRIPTION OF THE DRAWINGS

FIG. 1 is a top plan view with parts in section of a door latch mechanism constructed in accordance with this invention.

FIG. 2 is a view taken on the line 2—2 in FIG. 1.

FIG. 3 is a view taken on the line 3—3 in FIG. 2.

FIG. 4 is a sectional view taken on the line 4—4 in FIG. 2.

FIG. 5 is a view taken on the line 5—5 in FIG. 2, but with the cover plate removed.

FIG. 6 is similar to FIG. 5, showing the parts in a different position.

FIG. 7 is a sectional view taken on the line 7—7 in FIG. 3.

FIG. 8 is a sectional view taken on the line 8—8 in FIG. 7.

FIG. 9 is similar to FIG. 8, showing the parts in a different position.

DETAILED DESCRIPTION

Referring now more particularly to the drawings, the door latch mechanism there shown comprises a housing 10 on the inner side of the door having a latch 12, a latch operator or handle 14, a dead bolt 16 and bolt actuator 17. There is complementary mechanism 15 on the outer side of the door for operating the latch.

The housing 10 has a mounting portion 18 formed with a marginal flange 22 adapted to bear against the inner surface of the door 23 when mounted thereon adjacent to the swinging edge thereof by fasteners 24, as shown.

The latch 12 is pivotally mounted in the housing by a vertical pin 26. The latch has a latching arm 28 formed with an arcuate peripheral edge portion 30 adapted to engage the keeper slot 32 in a fixed door jamb 34. The latching arm 28 is relieved along one side where indicated at 36 to receive the operating arm of the latch operator 14, as more fully described hereinafter. The latch 12 has a second arm 38 at a substantial angle to the camming edge 40 of the latching arm which is engaged by a compression coil spring 42 mounted in the housing.

Spring 42 presses the latch to its extended or operative position shown in FIG. 1. The latch may be retracted to its inoperative position against the pressure of spring 42 to release the door.

The latch operator 14 is pivotally mounted in the housing on a vertical pin 44 parallel to pin 26. The latch operator has an operating arm 46, the tip 48 of which engages a surface 50 of the arm 38 of the latch to retract the latch when the latch operator is turned counterclockwise from the FIG. 1 position by hand pressure against the handle portion 52 formed on the second arm 54 of the latch operator.

The bolt 16 is an elongated member of generally square cross-section but relieved with slots on opposite sides to receive guide ribs 56 in the housing. The bolt is mounted in the housing for horizontal sliding movement on its longitudinal axis from an extended locking position shown in dotted lines in FIG. 3 in which it projects towards the door jamb for locking engagement in a complimentary recess, not shown, to a retracted position inside the housing.

The bolt actuator 17 has a hub 60 in the form of a circular disc mounted to turn on its own central horizontal axis which is perpendicular to the pivot pins 26 and 44. The hub 60 is mounted for axial rotation within the sleeve 62. The sleeve has mounting ring portions 64 engaged over studs formed within the mounting portion of the housing and retained thereon when the housing is bolted to the door by being clamped against the surface of the door.

The bolt actuator 17 has a ring 70 formed on the hub 60 in concentric relation therewith. Ring 70 projects radially beyond the hub and has a pin 72 near its periphery on one side which extends and engages in a vertical slot 74 formed in the adjacent side of the bolt. The latch operator may be rotated manually by means of a lever 76 projecting radially from the ring 70 through an opening 78 in the housing. When the bolt actuator is in the position of FIG. 8, pin 72 retains the bolt in the retracted or inoperative position. Rotation of the bolt to the FIG. 9 position causes pin 72 to move the bolt to its extended position in which it may project into a suitable recess in the door jamb to lock the door.

The ring 70 has an arcuate notch 71 in its outer edge portion of about 90° in extent. The ring is in a plane coinciding with the arcuate peripheral edge 30 of latch 12 (See FIGS. 8 and 9). When the bolt actuator is rotated to extend the bolt, the unnotched portion of the ring 70 extends behind this peripheral edge portion 30 as seen in FIG. 9, positively preventing the latch from being retracted. Hence the door is prevented from being opened not only by the bolt 16 but also by the locked condition of the latch. The effect is that of a double dead bolt. However, when the bolt actuator is turned to the FIG. 8 position, the notch 71 is brought into register with the latch to provide clearance so that the latch can be retracted in the normal way.

The complementary mechanism 15 on the outer side of the door for operating the latch comprises a housing 80 secured thereto by the fasteners 24. The housing has a recess 84 on the side facing the door. A plate 86 covers the recess and bears against the adjacent side of the door.

The housing 80 has a lower horizontal passage 88 which extends into the recess 84. An opening 89 in the outer wall 90 of the housing opens into the chamber.

A pusher assembly 92 extends through the passage 88. The pusher assembly comprises a push button 94 and a plunger 96. The push button 84 projects through the opening 89 and has a flange 98 inside the passage 88 which bears against the housing wall surrounding the opening 89 to prevent the button from separating from the housing. The button is capable of reciprocating horizontally within the passage 88, that is by finger pressure it can be pressed to the right in FIG. 2 in a direction in which it enters the housing passage.

The plunger 96 is an elongated member of non-circular, specifically oblong rectangular, cross-section. The outer end of the plunger is received in an cylindrical extension 100 of the push button and has a reduced section or notch in each of its edges into which an annular rib 102 in the extension extends to prevent separation of the push button and plunger, while permitting the plunger to rotate relative to the button. The plunger extends horizontally in the same direction as the button and is capable of reciprocating, through an opening 104 in plate 86 and through an opening in the door, with its inner end disposed adjacent to a pad 106 on the operating arm 46 of the latch operator 14. When the push button is depressed, that is, moved to the right in FIG. 2, the plunger 96 also moves longitudinally to the right and its inner end engages the pad 106 on the operating arm 46 to move the arm in a direction which retracts the latch 12.

The plunger extends through a rotatable member 110 which has a circular extension 112 on one end seated in the circular opening 104 in the cover plate 86. The hole in the rotatable member 110 through which the plunger 96 extends has the same non-circular cross-section as the plunger. The plunger 96 is capable of sliding in a lengthwise direction through the rotatable member 110, but rotation of the plunger causes the rotatable member 110 to rotate in opening 104. The rotatable member 110 has a flange portion 115 in the housing recess 84.

A compression coil spring 111 surrounds the plunger 96, bearing at one end against the rotatable member 110 and at the other end against the push button 94. As a result, the push button normally remains seated in the FIG. 2 position in which its flange 98 engages the outer wall of the housing and the rotatable member 110 remains seated with its extension 112 disposed within the opening 104 in the cover plate.

The housing 80 has a second passage 116 which is spaced vertically above the passage 88 and which likewise extends horizontally. The passage 116 opens through the outer wall 90 of the housing and has an enlarged cylindrical portion 117 which opens into the recess 84.

A rotatable member 120 has a cylindrical body portion 119 rotatably received in the enlarged portion 117 of passage 116 and has a flange portion 121 located in the housing recess 84.

The rotatable member 120 has a pair of arms 122, 124 projecting laterally outwardly from the opposite sides of the flange portion 121. The rotatable member 110 has a pair of arms 126, 128 projecting laterally outwardly from the opposite sides of the flange portion 115. A link 130 is pivotally connected at the ends of arms 122 and 126 of the respective members 110 and 120. A link 132 is pivotally connected at the ends of arms 124 and 128 of the respective members 110 and 120.

A key-operated locking unit has a plug 140 secured in the passage 116. The plug supports a rotatable shaft 142 which projects through an opening 144 in rotatable member 120. The shaft 142 has diametrically opposite, longitudinally extending ribs 146. The opening 144 has diametrically opposite, radially inwardly extending lugs 148. Thus, when the shaft 142 is rotated, the ribs 146 on the shaft engage the lugs to turn the rotatable member 120 between the positions of FIGS. 5 and 6. The shaft 142 is turned by means of a key 150 inserted in the plug 140 in the usual manner. In the FIG. 5 position of the linkage, the rotatable member 110 and plunger 96 are turned to the position extending bolt 16 and locking the latch 12 (FIG. 9). In the FIG. 6 position of the linkage, the rotatable member 110 and plunger are turned to the position retracting bolt 16 and releasing latch 12 (FIG. 8).

When not operated by a key, the shaft 142 is freely rotatable in its cylinder 140 to permit the latch 12 to be locked and released and the bolt 16 to be extended and retracted from the inside of the door by means of the handle 76.

I claim:

1. A door latch and lock mechanism comprising a latch, means for mounting said latch on a door for movement to and from an operative position in which it is adapted to engage a keeper to maintain the door closed, a housing adapted to be mounted on the outer side of the door, a latch-operating assembly mounted in said housing, said assembly including a manual operator adapted to be operated from the outer side of the door and being operable to move said latch away from its operative position in response to operation of said operator, locking mechanism including a locking member mounted for rotation and adapted to lock said latch in its operative position in response to rotation of said locking member from a first to a second position, and means for rotating said locking member comprising a first rotatable member mounted in said housing, a key plug mounted in said housing and operable by a key insertable into said plug from the outer side of said door, said plug having a key-operated shaft engaging said first rotatable member to rotate the latter, said locking member and said first rotatable member being laterally spaced apart and rotatable on laterally spaced, parallel axes, said manual operator and said key plug being laterally spaced apart in a direction transversely of said parallel axes, a second rotatable member rotatable with said locking member, and linkage connecting said first and second rotatable members so that rotation of said first rotatable member produces rotation of said second rotatable member and hence said locking member between said first and second positions thereof, each of said first and second rotatable members having an arm projecting outwardly therefrom, and said linkage comprising a link pivotally connected at its ends to said arms.

2. A door latch and lock mechanism comprising a latch, means for mounting said latch on a door for movement to and from an operative position in which it is adapted to engage a keeper to maintain the door closed, a housing, a pusher assembly mounted in said housing and comprising a manually reciprocable push button, a longitudinally movable plunger between said push button and latch extending lengthwise in the direction of button movement and having one end abutting said push button, the other end of said plunger being operable to move said latch away from its operative position in response to longitudinal movement of said plunger in one direction, spring means urging said push button and plunger in a direction opposite said one direction, said plunger being rotatable between a first position and a second position, means for locking said latch in its operative position in response to rotation of said plunger from its first to its second position, and means for rotating said plunger comprising a first rotatable member mounted in said housing, a key plug mounted in said housing having a key-operated shaft engaging said first rotatable member to rotate the latter, said first rotatable member and key plug being spaced laterally from said push button and plunger, a second rotatable member having a non-rotatable, sliding connection with said plunger so that said plunger can slide axially relative to said second rotatable member but is constrained to rotate with said second rotatable member, and linkage connecting said first and second rotatable members so that rotation of said first rotatable member produces rotation of said second rotatable member and plunger between the first and second positions of said plunger, each of said first and second rotatable members having a pair of arms projecting outwardly from opposite sides thereof, and said linkage comprising a first link pivotally connected at the ends to one arm of each rotatable member and a second link pivotally connected at the ends to the other arm of each rotatable member.

3. A door latch and lock mechanism comprising a latch, means for mounting said latch on a door for movement to and from a operative position in which it is adapted to engage a keeper to maintain the door closed, a housing, a pusher assembly mounted in said housing and comprising a manually reciprocable push button, a longitudinally movable plunger between said push button and latch extending lengthwise in the direction of button movement and having one end abutting said push button, the other end of said plunger being operable to move said latch away from its operative position in response to longitudinal movement of said plunger in one direction, spring means urging said push button and plunger in a direction opposite said one direction, said plunger being rotatable between a first position and a second position, a locking bolt movable from an extended, locking position to a retracted, unlocked position, means for moving said locking bolt from its retracted to its extended position in response to rotation of said plunger from its first to its second position, and means for rotating said plunger comprising a first rotatable member mounted in said housing, a key plug mounted in said housing having a key-operated shaft engaging said first rotatable member to rotate the latter, said first rotatable member and key plug being spaced laterally from said push button and plunger, a second rotatable member having a non-rotatable, sliding connection with said plunger so that said plunger can slide axially relative to said second rotatable member but is constrained to rotate with said second rotatable member, and linkage connecting said first and second rotatable members so that rotation of said first rotatable member produces rotation of said second rotatable member and plunger between the first and second positions of said plunger, each of said first and second rotatable members having a pair of arms projecting outwardly from opposite sides thereof, and said linkage comprising a first link pivotally connected at the ends to one arm of each rotatable member and a second link pivotally connected at the ends to the other arm of each rotatable member.

4. Door latch mechanism as defined in claim 3, wherein said means for moving said locking bolt from its retracted to its extended position in response to rotation of said plunger from its first to its second position has means for simultaneously locking said latch in its operative position.

5. A door latch and lock mechanism comprising a latch, means for mounting said latch on a door for movement to and from an operative position in which it is adapted to engage a keeper to maintain the door closed, a housing adapted to be mounted on the outer side of the door, a latch-operating assembly mounted in said housing, said assembly including a manual operator adapted to be operated from the outer side of the door and being operable to move said latch away from its operative position in response to operation of said operator, a locking bolt movable from an extended, locking position to a retracted, unlocked position, a locking member mounted for rotation and operable to move said locking bolt from its retracted to its extended position in response to rotation of said locking member from a first to a second position, and means for rotating said locking member comprising a first rotatable member mounted in said housing, a key plug mounted in said housing and operable by a key insertable into said plug from the outer side of said door, said plug having a key-operated shaft engaging said first rotatable member to rotate the latter, said locking member and said first rotatable member being laterally spaced apart and rotatable on laterally spaced, parallel axis, said manual operator and said key plug being laterally spaced apart in a direction transversely of said parallel axes, a second rotatable member rotatable with said locking member, and linkage connecting said first and second rotatable members so that rotation of said first rotatable member produces rotation of said second rotatable member and hence said locking member between said first and second positions thereof, each of said first and second rotatable members having an arm projecting outwardly therefrom, and said linkage comprising a link pivotally connected at its ends to said arms.

* * * * *